US011629418B2

(12) United States Patent
Crettenand et al.

(10) Patent No.: US 11,629,418 B2
(45) **Date of Patent: *Apr. 18, 2023**

(54) BY-PRODUCTS (IMPURITY) REMOVAL

(71) Applicant: Sedo Engineering SA, Riddes (CH)

(72) Inventors: David Crettenand, Riddes (CH); Grégoire Chappot, Savièse (CH); Ludovic Chappot, Charrat (CH); Herbert Gübeli, Goldingen (CH)

(73) Assignee: Sedo Engineering SA, Riddes (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/296,785

(22) PCT Filed: Nov. 29, 2019

(86) PCT No.: PCT/EP2019/083144
§ 371 (c)(1),
(2) Date: May 25, 2021

(87) PCT Pub. No.: WO2020/109583
PCT Pub. Date: Jun. 4, 2020

(65) Prior Publication Data

US 2022/0025534 A1 Jan. 27, 2022

(30) Foreign Application Priority Data

Nov. 30, 2018 (CH) ..... 01481/18

(51) Int. Cl.
*C25B 15/08* (2006.01)
*C25B 3/25* (2021.01)
(Continued)

(52) U.S. Cl.
CPC ..... *C25B 15/085* (2021.01); *C25B 3/05* (2021.01); *C25B 3/25* (2021.01); *C25B 9/19* (2021.01);
(Continued)

(58) Field of Classification Search
CPC .... C25B 3/05; C25B 3/25; C25B 9/19; C25B 9/40; C25B 9/70; C25B 13/02; C25B 13/05; C25B 15/08; C25B 15/085
See application file for complete search history.

(56) References Cited

U.S. PATENT DOCUMENTS 3,701,719 A * 10/1972 Leduc et al. ..... C25B 15/08 205/688
3,966,571 A 6/1976 Gagnon et al.
(Continued)

FOREIGN PATENT DOCUMENTS

CN 103255642 A 7/2015
CN 105603453 A 5/2016
(Continued)

OTHER PUBLICATIONS

Roessler et al., "Electrochemical reduction of indigo in fixed and fluidized beds of graphite granules", Journal of Applied Electrochemistry 33:901-908, 2003.
(Continued)

*Primary Examiner* — Ciel P Contreras
(74) *Attorney, Agent, or Firm* — Renner, Otto, Boisselle & Sklar, LLP

(57) ABSTRACT

An electrolytic reactor comprises at least one electrolytic cell with an anode compartment and a cathode compartment separated by a separator, in particular a semipermeable membrane. The anode compartment comprises an inlet and an outlet for anolyte at opposed ends, said inlet and outlet being connected with each other via an anolyte circulation pipe equipped with a storage means for anolyte, an anolyte vessel and at least one adsorption filter for adsorbing molecular impurities. When molecular impurities comes
(Continued)

from the cathode compartment through the separator, the electrolytic reactor acts also as a cleaning device for the catholyte.

20 Claims, 6 Drawing Sheets

(51) Int. Cl.

| | |
|---|---|
| ***C25B 9/70*** | (2021.01) |
| ***C25B 3/05*** | (2021.01) |
| ***C25B 9/19*** | (2021.01) |
| ***C25B 13/05*** | (2021.01) |
| ***C25B 13/02*** | (2006.01) |

(52) U.S. Cl.
CPC ..... *C25B 9/70* (2021.01); *C25B 13/02* (2013.01); *C25B 13/05* (2021.01)

(56) References Cited

U.S. PATENT DOCUMENTS

| | | | | |
|---|---|---|---|---|
| 5,244,549 | A | 9/1993 | Bechtold | |
| 5,586,992 | A | 12/1996 | Schnitzer et al. | |
| 5,922,087 | A | 7/1999 | Nishioka et al. | |
| 6,627,063 | B1 | 9/2003 | Marte et al. | |
| 2003/0098246 | A1 | 5/2003 | Merk et al. | |
| 2004/0069653 | A1 | 4/2004 | Merk et al. | |
| 2005/0121336 | A1 | 6/2005 | Marte et al. | |
| 2009/0242422 | A1 * | 10/2009 | Kurosu | C25B 1/14 205/350 |
| 2009/0308757 | A1 | 12/2009 | Crettenand | |
| 2015/0298998 | A1 | 10/2015 | Legzdins | |
| 2018/0023202 | A1 | 1/2018 | Krause et al. | |

FOREIGN PATENT DOCUMENTS

| | | | | |
|---|---|---|---|---|
| DE | 102015202117 | | 8/2016 | |
| EP | 1297200 | | 1/2007 | |
| EP | 0760805 | | 1/2008 | |
| GB | 1239983 | | 7/1971 | |
| JP | H10130876 | | 5/1998 | |
| WO | 1990/015182 | | 12/1990 | |
| WO | 1994/023114 | | 10/1994 | |
| WO | WO-9507374 | A1 * | 3/1995 | C25B 15/00 |
| WO | 2000/031334 | | 6/2000 | |
| WO | 2001/046497 | | 6/2001 | |
| WO | 2007/147283 | | 12/2007 | |
| WO | 2020/109577 | A1 | 6/2020 | |
| WO | 2020/109595 | A1 | 6/2020 | |

OTHER PUBLICATIONS

Written Opinion and International Search Report for corresponding application PCT/EP2019/083144, dated Mar. 4, 2020.

Roessler et al., "Electrocatalytic Hydrogenation of Indigo: Process Optimization and Scale-Up in a Flow Cell", Journal of the Electrochemical Society, vol. 150, No. 1, Nov. 2002.

Bechtold, et al. "Reduction of Dispersed Indigo Dye by Indirect Electrolysis", VCH Verlagsgesellschaft mbH. W-6940 Weinheim, 1992.

* cited by examiner

BY-PRODUCTS (IMPURITY) REMOVAL

This application is a national phase of International Application No. PCT/EP2019/083144 filed Nov. 29, 2019 and published in the English language, which claims priority to Switzerland Application No. 01481/18 filed on Nov. 30, 2018, the entire disclosures of which are hereby incorporated by reference.

TECHNICAL FIELD

The disclosure pertains to the field of electrolysis with flown through cells suitable for the reduction of vat dyes like indigo and sulfur dyes.

BACKGROUND ART

Reduction of vat dyes and sulfur dyes by means of electrolysis is already known (see e.g. WO 2007/147283 A2). While electrolysis is a clean method since it involves less chemicals than other reduction methods, it suffers from decreasing performance upon use, at least in part due to electrode contamination.

DE 10 2015 202 117 A1 discloses an electrochemical method for converting carbon dioxide into carbon monoxide, methane or ethene. Undesired by-products are formiates that can deposit onto the electrode surface. These by-products are generated in the cathode compartment and removed therefrom by means of a filter positioned downstream of a gas separation.

U.S. Pat. No. 3,701,719 A discloses the electrochemical production of olefin oxides from olefins via a halohydrin intermediate. Both the anode and the cathode compartments are needed for generation of the intermediate or the final product, respectively. With regard to the contaminants removal the document teaches first separating the product, i.e. the olefin oxide from the aqueous medium, then introducing an inorganic oxidizing agent into the aqueous medium containing the contaminant, then passing the aqueous medium treated with oxidizing agent through a contaminant removal zone and recirculating the decontaminated aqueous medium to the electrolytic cell.

None of these documents deals with the removal of non-gaseous by-products or contaminants from a solution comprising non-gaseous products.

DISCLOSURE OF THE INVENTION

Hence, it is a general object of the invention to provide an electrolytic reactor suitable for dye reduction with improved performance and lifetime, with longer intervals between regenerations and preferably also resulting in purer dyes.

Now, in order to implement these and still further objects of the invention, which will become more readily apparent as the description proceeds, the electrolytic reactor is manifested by the features that it comprises at least one electrolytic cell with an anode compartment and a cathode compartment, said compartments being separated by a separator, in particular a semipermeable membrane, said compartments each comprising an inlet and an outlet for anolyte and catholyte, respectively, at opposed ends, said inlet and outlet of each compartment being connected with each other via an anolyte circulation pipe or a catholyte circulation pipe, said anolyte circulation pipe being equipped with an anolyte vessel to form an anolyte circuit and said catholyte circulation pipe being equipped with a main vessel to form a catholyte circuit, wherein the anolyte circulation pipe is further equipped with at least one adsorption filter, said adsorption filter comprising an adsorption material for adsorbing molecular impurities.

In the following description some terms are used the meaning of which is further defined below:

The term "suspension" in combinations such as diluted suspension, leucodye comprising suspension also means a catholyte, provided that the suspension is disclosed as being forwarded to an electrolytic cell. The finally reduced product is also termed leucodye solution.

The term "basic electrolyte" does not necessarily mean that it has a basic pH, i.e. pH>7, but that it is freshly supplied, i.e. dye-free, electrolyte solution. In general, however it is preferred that the basic electrolyte has basic pH.

The term "pipe" as used herein encompasses all hollow cylinder like means, i.e. not only rigid pipes but also flexible tubes.

In the scope of the present invention it has been found that due to osmotic pressure difference between the cathode and anode compartments, small molecules present in the substances used or generated through electrolysis can migrate from one compartment to the other compartment through the separator, in particular the semipermeable membrane, and contaminate the electrode. In particular in dye reduction processes small molecules migrate from the cathode to the anode compartment, in particular the anode itself, thereby affecting the anode's performance. In case of indigo such molecular impurities are in particular aniline. If such molecules are able to polymerize or otherwise react to insoluble substances due to the conditions in the anode compartment or at the anode itself, the anode loses its activity and the cell has to be shut down for possibly time consuming anode cleaning.

The present invention is especially suitable in dye reduction and therefore is described in more detail for such a preferred embodiment.

With suitable filters, molecular impurities can be removed from the analyte to a high extent resulting in less contamination of the anode, larger intervals between cleaning/regeneration cycles and conservation of an osmotic pressure difference. If the sole impurities present stem from impurities in the dye, the osmotic pressure driven migration of the impurities from the cathode compartment into the anode compartment depletes the catholyte from such impurities resulting in a purer catholyte. If small molecules are generated during reduction, and if the osmotic pressure driven migration of such molecules from the cathode compartment to the anode compartment is faster than the generation of such molecules, also cleaner catholytes are obtained.

Dependent on the kind of molecule or molecules to be removed different adsorbent filter materials can be used, in particular adsorbent filter materials that can be regenerated with low effort. For example aniline, one of the major impurities in indigo dyeing, has a boiling point of about 184° C. and thus the adsorbent material can be regenerated at temperatures around 200° C., in the case of additionally applied vacuum at lower temperatures or in shorter time.

Suitable adsorption filter materials are e.g. activated carbon and molecular sieves like zeolites. For good anolyte flow through the adsorption filter, particle sizes of about 1 to 3 mm, in particular about 2 mm are preferred. Dependent on the adsorption filter's dimensions, the desired flow, the concentration of the impurities in the anolyte and the adsorption characteristics (kinetic and thermodynamic) the package density of the adsorption material may vary and also the shape of the adsorbent granules, i.e. spheric or irregular. Optimal conditions can easily be evaluated for a specific process.

A preferred electrochemical cell of the present invention comprises a particulate cathode, in particular a conductive carbon cathode like a graphite cathode.

In another preferred embodiment the catholyte comprises a vat dye or sulphur dye, much preferred indigo.

The removal of small molecules like aniline that is e.g. one of the impurities found in indigo, not only reduces deposits on the anode but also results in purer leucodye and thus also in purer colored fabrics. In particular in case of aniline, known to be a strong blood poison, this is a major advantage.

Dye catholytes in general comprise suspension stabilizing agents, in particular dispersing agents, also termed dispersants. If under reducing conditions such stabilizing agents are not sufficiently stable, and in particular if they decay into small molecules, they may as well migrate to the anode compartment and be removed by the adsorption filter so that—with time—the suspension is depleted from dispersing agent which might—at least in an early stage of the reduction process—affect suspension stability.

Thus the use of an adsorption filter in the anolyte circuit is especially suitable in a reduction process that does not involve stabilizing agents, e.g. dispersants. A new and inventive process that needs no dispersing agents other than dye compounds, in particular leucodye, has also been developed. Such method further on is called a dispersant-free method. Since the leucodye is too big to pass through the separator there is no risk that its stabilising effect is diminished due to depletion because the removal of the molecules from the anolyte upholds osmotic diffusion.

In order to generate a dispersant-reduced or in particular a dispersant-free catholyte for the first time, i.e. if no respective leucodye solution is available, the reduction or leucodye production method, respectively, in an electrolytic reactor can be started in that (i) a diluted suspension of dye in basic electrolyte is prepared in the main vessel or in the first and the main vessel by circulating and heating the suspension, optionally by improving the suspension by circulating it through one or more ultrasound apparatuses, (ii) the diluted suspension of step (i) is electrochemically treated in at least one electrolytic cell to obtain a diluted leucodye solution, (iii) the diluted leucodye solution of step (ii) can optionally be forwarded into the first vessel or the main vessel and there supplied with further dye to obtain a leucodye comprising suspension by circulating and heating, (iv) the leucodye comprising suspension of step (iii) is then circulated through the at least one electrolytic cell for electrolytic conversion of the dye to the leucodye or the leucodye comprising suspension to a leucodye comprising solution, respectively, optionally (v) repeating steps (iii) and (iv) one or more times with the leucodye solution of step (iv) and further dye to form a leucodye solution in basic electrolyte.

Steps (iii) to (v) are optional, i.e. they are only performed if the leucodye concentration obtained in step (ii) is not sufficiently concentrated to provide suitable suspending effect.

For indigo as a preferred example, the dye suspension in step (i) preferably has a concentration of 100 to 200 g/l in basic electrolyte, e.g. sodium hydroxide of a concentration of 2 to 10% w/v, preferably 4% w/v. The indigo suspension in a first step (iii) has a concentration of indigo and leucoindigo of 150 to 250 g/l, in a second step (iii) of 250 to 350 g/l and in a third step (iii) of 300 to 380 g/l.

Concentrated leucodye solution can be prepared starting with leucodye comprising basic electrolyte. This leucodye comprising basic electrolyte is either produced as indicated above or stems from a former production of concentrated leucodye. In the second case, some of the leucodye solution is left in the reactor upon removal of the batch of concentrated leucodye solution. This concentrated leucodye solution is then diluted with basic electrolyte to form leucodye comprising basic electrolyte solution.

Producing a concentrated leucodye solution in an electrochemical reactor using leucodye comprising basic electrolyte solution can be performed in that (i) a first part of a dye to be reacted to leucodye is added to a leucodye comprising basic electrolyte solution in the first vessel or in the main vessel and circulated, optionally through one or more ultrasound apparatuses and preferably heated to form a first catholyte, (ii) forwarding the first catholyte of step (i) preferably via a filter for removing oversized particles and optionally a heating means, into at least one electrolytic cell and (iii) starting the at least one electrolytic cell by stepwise enhancing the voltage to conversion voltage and maximum conversion power, (iv) adding a further part of dye to be reacted thereby enhancing the power, preferably to maximum power and continuing conversion (v) optionally repeating step (iv) until desired concentration of the leucodye is achieved, (vi) converting the dye to leucodye until the power diminishes to a threshold conversion power due to dye conversion, (vii) removing the leucodye solution.

The addition of further dye can be performed by adding solid dye into the main vessel or by feeding part of the leucodye comprising solution or suspension from the main vessel or the catholyte circulation loop into the first vessel where it is diluted with basic electrolyte and solid dye and circulated for forming a suitably homogeneous suspension that is then fed to the main vessel.

In general and in particular for indigo it has been found that a leucodye solution in basic electrolyte with a leucodye concentration of only 5% w/v is able to stably suspend up to 20% w/v of dye, such as from 5 to 10% w/v leucodye for 10 to 20% w/v dye.

For producing a concentrated leucoindigo solution the following procedure has proved to be good:

A good final leucoindigo solution is e.g. obtained with 300 kg of indigo in 1000 to 1500 l electrolyte.

For starting, part of the leucoindigo solution is left in the main vessel or pumped into the first vessel for being supplemented with basic electrolyte, e.g. produced from a concentrated electrolyte and water, and indigo. It has been proved suitable to retain about 200 l leucoindigo solution in the vessel that is then supplemented with 300 to 600 l of basic electrolyte. Due to further leucoindigo solution in the pipes and electrolytic cells etc. the leucoindigo concentration is enhanced as soon as mixed with the content of the pipes, cells etc. Thus, although a 5% leucoindigo concentration is enough for stabilizing a suspension with up to 20% of indigo, in general higher leucoindigo concentrations are used. Volume information given below refers to the volume in the first and the main vessel.

A first part, e.g. 150 kg, of indigo to be reacted to leucoindigo is added to 500 l of a leucoindigo comprising basic electrolyte solution (preferably leucoindigo concentration 15% to 20%, NaOH concentration 2% to 10%, in particular about 4%, in the first vessel or—if no first vessel is present—in the main vessel and circulated, optionally through one or more ultrasound apparatus, and heated to form a first indigo suspension. If a first vessel is present, the suspension is circulated through the first vessel and an ultrasound apparatus for about 30 min. Once pumped into the main vessel it is again circulated for about 20 min. through a second ultrasound apparatus and—at least when ready for supply to the cathode—through a particle filter and a heat exchanger.

Once the suspension is homogeneous (indigo particle size under 50 μm) and has the desired temperature of about 50° C. to 65° C., preferably 60° C., the first indigo suspension is forwarded into the electrolytic cells (all cells of all working stacks in parallel) and the electrolytic cells—e.g. all stacks—are then started by stepwise enhancing the voltage to conversion voltage and maximum conversion power, e.g. from 7 volt to 11 volt in steps of 0.5 volt about each two min. All cells of one stack and preferably also all stacks are simultaneously fed and started. The preparation of step (i) takes about 1 to 2 hours, starting the electrochemical process about 15 min.

At the maximum conversion voltage of 11 volt, the conversion power is about 170 A for an indigo suspension comprising 150 kg indigo in 500 to 800 l leucoindigo catholyte. As soon as the maximum current is reached, further indigo, e.g. 50 kg in leucoindigo solution, is prepared in the first vessel and supplied to the main vessel resulting in again enhanced current and the reduction is continued. The leucoindigo solution used for suspending the indigo in general is diluted with electrolyte to a leucoindigo concentration of 5 to 20%, more preferred 10 to 20% weight per volume (w/v).

Once all the indigo has been added, e.g. 3 times 50 kg in about 150 to 400 l to a total of 300 kg in 1000 to 1500 l electrolyte, the power diminishes with the decreasing indigo concentration. Since no further indigo shall be supplied, the voltage is also slowly reduced dependent on the measured power or dependent of the indigo concentration, respectively.

It has also been found that cleaning/regeneration of the anode compartment or the anode, respectively, but also the cathode compartment can easily be done by washing with strong acid, in particular if the process is performed with the above indicated improvements. The acidic solution can be circulated through the anode and/or the cathode either for a specific time or until the cleaning solution has reached a predetermined or constant level of impurities. Then the anode is washed either with water directly or after washing with a base like caustic soda, in general also by circulating the base through the anode compartment.

In e.g. indigo reduction, the acid washing is performed for a suitable time such as 10 to 60 min. followed by washing the bed with a base like caustic soda (to remove the acid and contamination of the electrode) followed by water washing or—less preferred—by washing with water directly. While the washing can be performed for both electrodes, i.e. the cathode and the anode simultaneously, in case of several stacks of electrolytic cells it is preferred to perform the cleaning/regeneration of the cathode and the anode in a subsequent manner, i.e. first the cathodes of all stacks, in a preferred embodiment one stack at a time and during suspension preparation, followed by cleaning of all anodes of one stack.

Cleaning the electrodes during suspension preparation has the advantage that all stacks remain in leucodye production, and since the preparation of a fresh suspension in the batch procedure takes at least 1 hour while longer, i.e. up to two hours, circulation through ultrasound apparatuses improves the suspension quality, there is almost the same time needed for careful cleaning/regeneration of the electrodes and suspension preparation. Thus, performing the two steps simultaneously does not or only minimally extend the time needed anyway.

Suitable acidic solutions have a concentration in the range of 10 to 100 g/l, more preferred 40 to 60 g/l, most preferred about 50 g/l, or 0.25 to 30 M, preferably 1 to 2 M, more preferred 1.3 to 1.4 M (referred to the protons) in deionized water. If a basic solution like caustic soda is used following the acid solution cleaning, the concentration in general is in the range of 10 to 100 g/l, more preferred 20 to 60 g/l, most preferred 40 g/l, or 0.1 to 2.5 M, preferably 0.5 to 1.5 M (referred to hydroxide) in deionized water.

For the washing step the strong acid is preferably selected from the group consisting of HCl, $H_2SO_4$, $HNO_3$ and mixtures thereof.

The washing solutions can be circulated through filters in order to retain small particles of metallic origin or abraded electrode material and through carbon or other adsorption filters to adsorb dissolved contaminants.

BRIEF DESCRIPTION OF THE DRAWINGS

The invention will be better understood and objects other than those set forth above will become apparent when consideration is given to the following detailed description thereof. This description makes reference to the annexed drawings, wherein.

MODES FOR CARRYING OUT THE INVENTION

The method will now be further illustrated for a dye reduction method, in particular an indigo reduction method.

Figure 1:
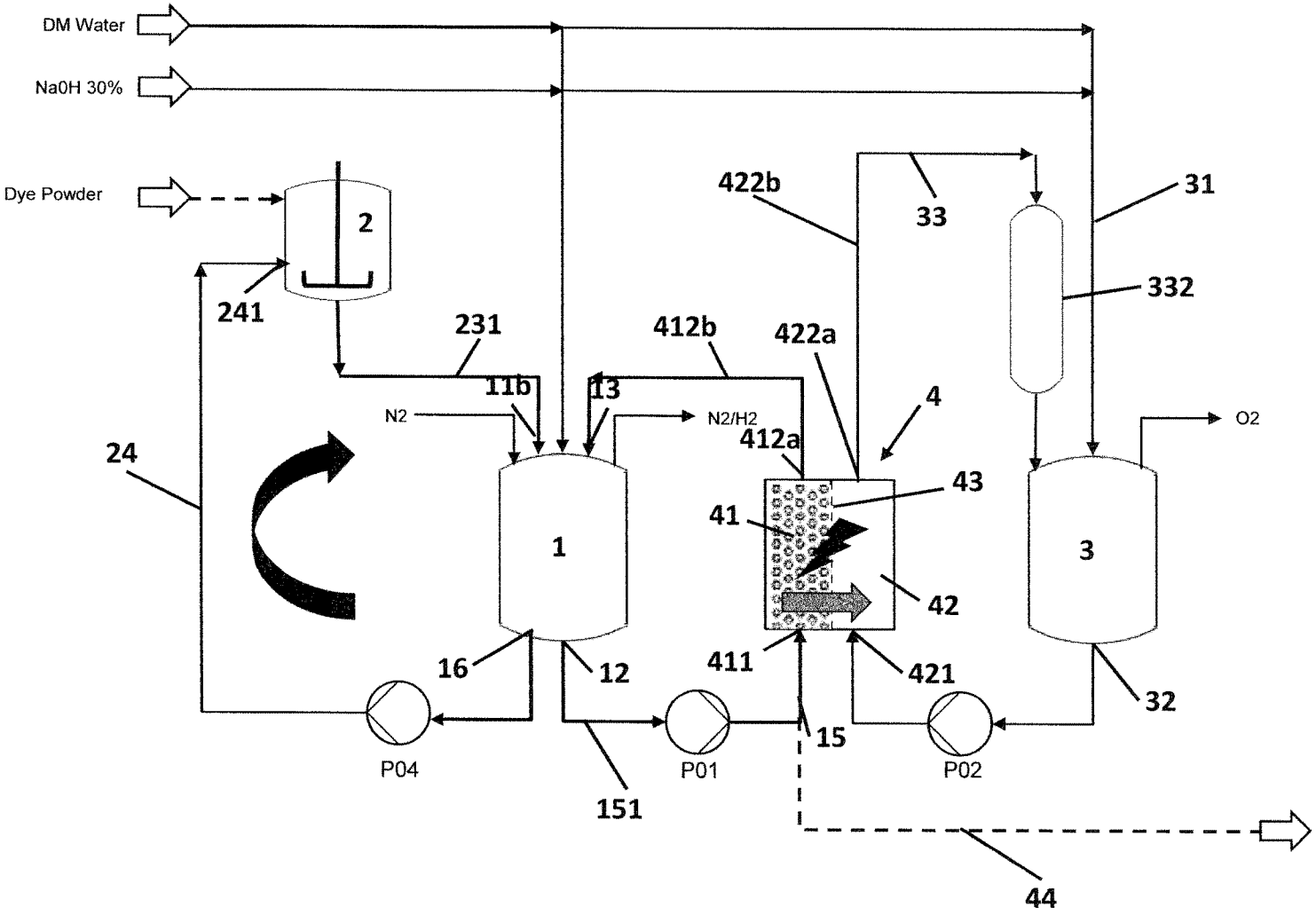
FIG. 1 shows the by-product removal in a method wherein leucodye is used as dispersant and preferably as sole dispersant.
Figure 3:
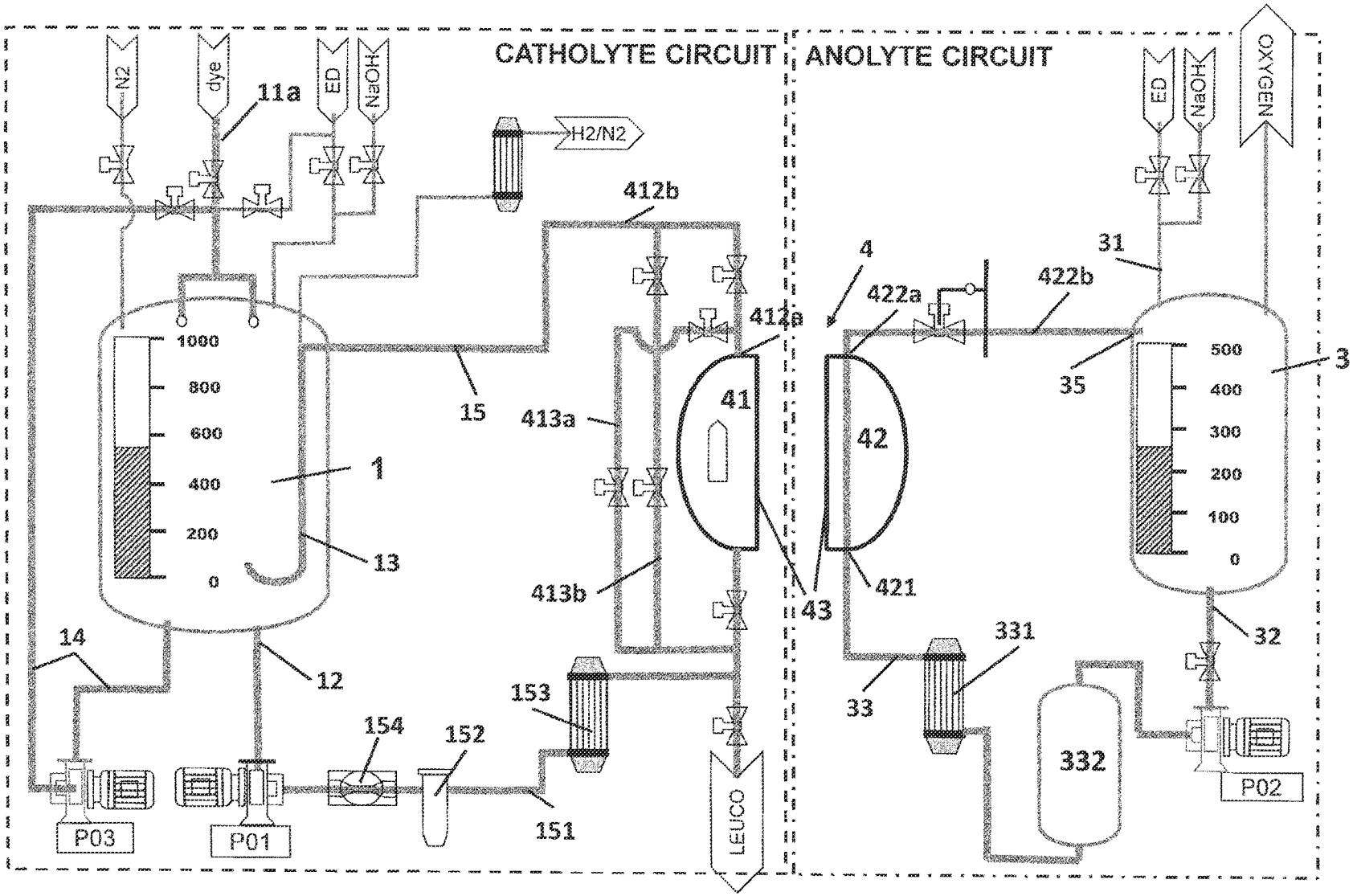
FIG. 3 shows the main parts of a whole electrochemical reactor suitable for by-product removal with the electrolytic cell in exploded view.

FIG. 1 shows the basic equipment of an anolyte circuit with an electrolytic cell 4 comprising a cathode compartment 41 and an anode compartment 42 separated from each other by a separator 43, in particular a semipermeable membrane. The anolyte vessel 3 is fed with electrolyte, in particular caustic soda via anolyte supply pipe 31. From anolyte vessel 3 the anolyte is fed to the anode compartment 42 via anolyte outlet 32 into anolyte circulation loop or anolyte circulation pipe 33, respectively equipped with a anolyte circulation pump P02. The anolyte enters the anode compartment via anolyte inlet 421, passes through the anode compartment 42 and is returned from the anode compartment 42 via anolyte outlet 422*a* and anolyte return pipe 422*b* into the anolyte vessel 3. Also provided within the anolyte circulation loop is an adsorption filter 332 that can be placed anywhere in the loop, as shown in FIG. 1 e.g. between the anolyte outlet 422*a* and the anolyte vessel 3 or—as shown in FIG. 3—between the anolyte outlet 32 of anolyte vessel 3 and the anolyte inlet 421 into the anode compartment 42. As also shown in FIG. 1 the catholyte is supplied from a main vessel 1 via catholyte outlet 12 and catholyte supply pipe 151 equipped with catholyte supply pump P01 via catholyte inlet 411 into the cathode compartment 41, through the cathode compartment 41 and back via reduced catholyte outlet 412*a*, reduced catholyte return pipe 412*b* and reduced catholyte inlet 13 back into main vessel 1.

Figure 4:
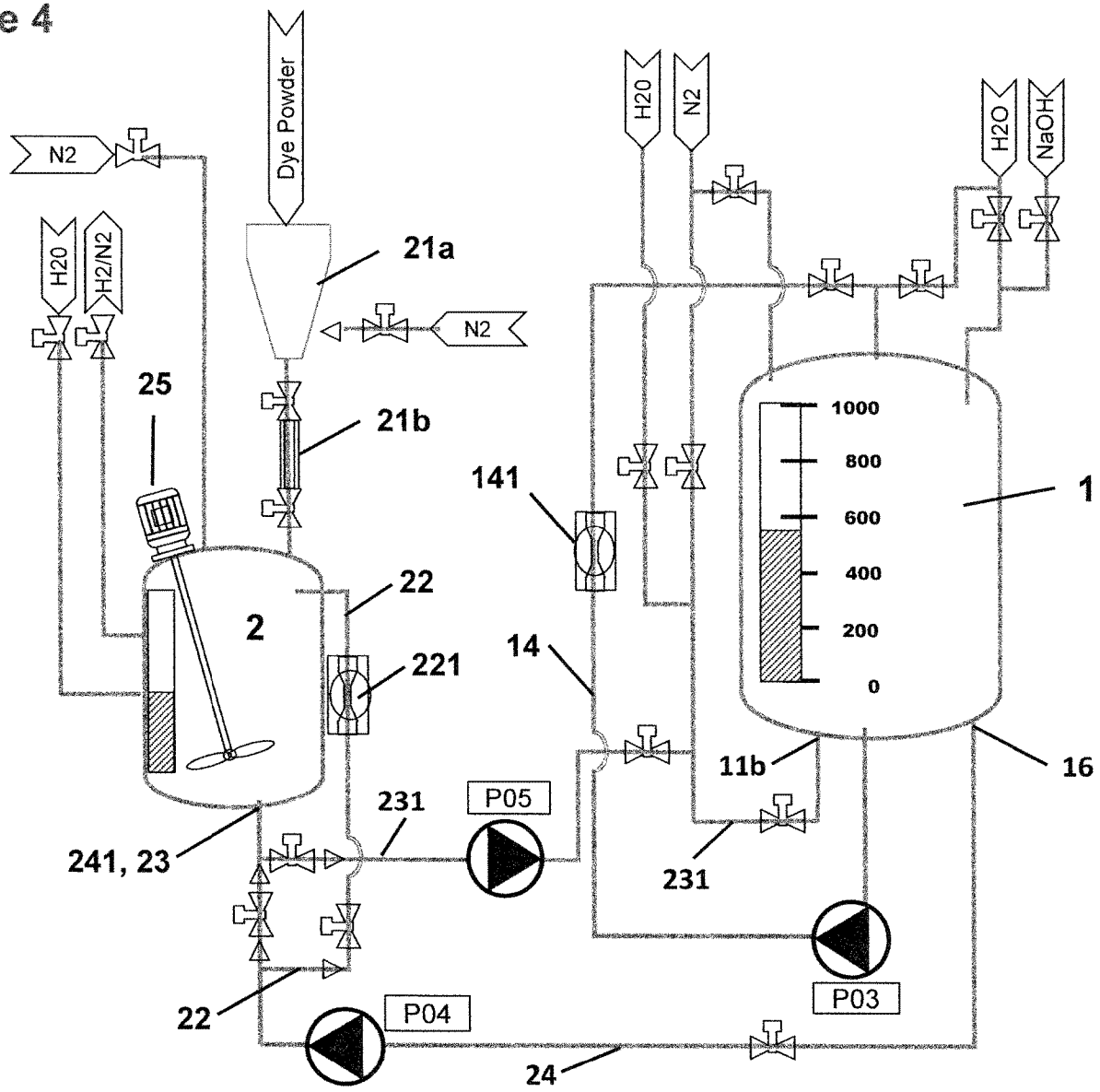
FIG. 4 shows in more detail the part of the electrolytic reactor that serves the catholyte preparation in the presence of a first vessel.

As also indicated in FIG. 1, the catholyte suspension can be prepared in a first vessel 2 that—in a preferred embodiment—uses leucodye comprising electrolyte as suspending medium, i.e a medium free of dispersing agent other than leucodye. In a first step, dye is suspended in electrolyte and preferably circulated in the first vessel 2 via an ultrasound apparatus (as shown in FIG. 4) prior to being forwarded to main vessel 1 and then subjected to reduction by circulating it via cathode compartment 41. Once the reduction has been completed, at least part of the leucodye comprising electrolyte solution is returned from main vessel 1 into first vessel 2 by means of pump P04 (as indicated by the semicircled arrow), where it is supplemented with further dye and processed as described before.

If desired, a further circulation loop for improving the suspension prior to feeding it to the cathode compartment 41 can be provided in the main vessel 1, e.g. also equipped with an ultrasound apparatus and optionally also with a heating means (see FIG. 3).

While FIG. 1 (and also the other Figures) only show one electrolytic cell, for industrial purposes it is preferred to have at least 4 electrolytic cells in at least two stacks of two electrolytic cells each.

Figure 2A:
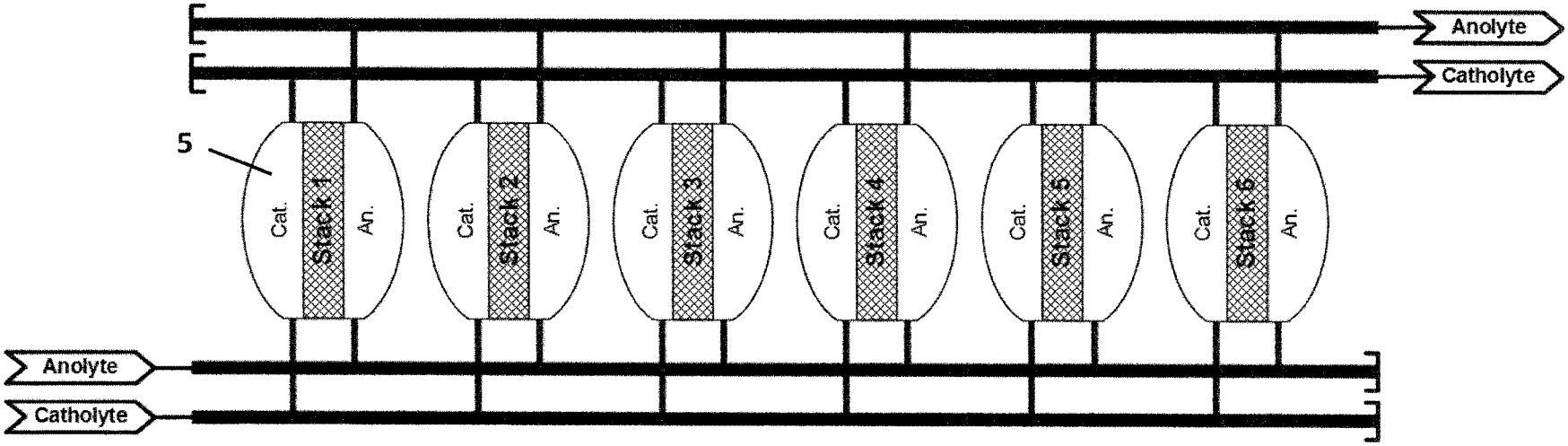
FIG. 2*a* shows schematically six stacks with the relevant supply and withdrawal lines and FIG. 2*b* one stack with five electrolytic cells more detailed.
Figure 2B:
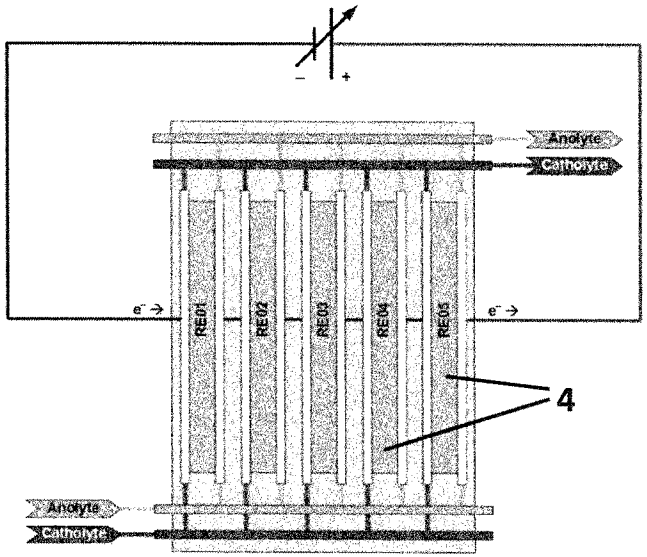

An arrangement of several stacks 5 of electrolytic cells 4, each stack comprising several electrolytic cells 4, and all stacks 5 and all electrolytic cells 4 of one stack 5 being connected in parallel for easy separation of one stack for cleaning/regeneration, is shown in FIG. 2.

A preferred number of stacks is at least 4, more preferred 6. In case of 6 stacks, in general all are working but in case of more than two hours taking maintenance preferably 5 are working, while 1 is off. In case of 6 stacks 5, in general one at a time is separated for cathode washing/regeneration during leucodye suspension preparation, so that the cathodes of all stacks are cleaned within 6 days and all anodes of one stack are cleaned together on day 7. Since the anodes need less regeneration than the cathodes it proved advantageous to also clean them stackwise after the cleaning of all cathodes, i.e. the cathodes of each stack once a week, all anodes of one stack once all 7 weeks.

Cleaning the electrodes during suspension preparation has the advantage that all stacks remain in leucodye production, and since the preparation of a fresh suspension in the batch procedure takes at least 1 hour while longer, i.e. up to two hours, circulation through ultrasound apparatuses improves the suspension quality, there is almost the same time needed for careful cleaning/regeneration of the electrodes and suspension preparation. Thus, performing the two steps simultaneously does not or only minimally extend the time needed anyway.

At least the cleaning of the cathodes of one stack only at a time has several advantages, namely

- the water needed for suspension preparation can be supplied via the cathodes of the stack to be regenerated thereby avoiding loss of leucodye,
- the water needed for suspension preparation is sufficient to remove all leucodye from one stack but might be less efficient in the case of several stacks,
- since the cleaning solutions are recycled, less cleaning solutions are needed.

Each stack preferably comprises from 1 to 10 electrolytic cells, preferably 4 to 6 electrolytic cells, in particular 5 electrolytic cells. For an electrochemical reactor suitable for producing 1000 kg of leucodye, in particular leucoindigo solutions of a concentration of e.g. 30% within 24 h, an electrochemical reactor with 6 stacks (in general all 6 stacks but at least 5 stacks working) of 5 electrolytic cells each has proved suitable, in particular for electrolytic cells with a cathode compartment having the following dimensions and a particulate carbon cathode:

- 0.3 $m^2$ separator area per cell
- Dimensions of the cathode compartment containing particulate graphite carbon are 0.4 m high, 0.7 m large and 0.04 m thick
- Dimensions of the carbon granules are between 1 mm to 0.3 mm
- Dimensions of the stainless steal cathode current collector and the anode are 0.6 m high and 0.9 m large.

Further information on a suitable electrode can be found in WO 2007/147283 A2 the disclosure of which is incorporated herein in its entirety. Such information regards e.g. the determination of the sphericity and the flow properties.

FIG. 3 shows an electrolytic reactor in more detail but without a first vessel 2.

As already shown in FIG. 1, an anolyte is supplied to anolyte vessel 3 via anolyte supply pipe 31 or—once the reduction has been started—anolyte inlet 35 and supplied to the anode compartment 42 via anolyte outlet 32, anolyte pump P02, anolyte heating means 331 and anolyte inlet 421. Having left the anode compartment 42 via anolyte outlet 422*a*, the anolyte is recirculated to anolyte vessel 3 via anolyte return pipe 422*b* and anolyte inlet 35.

An adsorption filter 332 is provided within the anolyte circuit. As already indicated, this adsorption filter 332 can be placed anywhere, however, if a heating means is present, it is preferably placed just before the anolyte heating means 331 since there the temperature is lowest and thus adsorption best.

On the cathode side of the reactor, the main vessel 1 is provided with a main suspension circulation loop 14 comprising a main suspension circulation pump P03 and preferably an ultrasound apparatus 141 (see FIG. 4) for circulating the suspension thereby improving its homogeneity.

When the suspension has been circulated for some time (dependent on the quality of the dye, i.e. its particle size and particle distribution) the main suspension circulation loop 14 is closed and the valve to the catholyte outlet 12 is opened. The catholyte is then circulated through catholyte circulation loop 15 by pumping it by the catholyte pump P01 via catholyte supply pipe 151 through a further optional ultrasound apparatus 154, a particle filter 152 for removing oversized particles if still present and a catholyte heating means (heat exchanger) 153 via catholyte inlet 411 into the cathode compartment 41 of the electrolytic cell 4 separated from the anode compartment 42 by a separator 43, preferably a semipermeable membrane. After having passed the cathode, the catholyte is returned to the main vessel 1 via reduced catholyte outlet 412*a*, reduced catholyte return pipe 412*b* and reduced catholyte inlet 13.

As indicated by reference numbers 413*a* and 413*b*, in a preferred embodiment the catholyte direction can be inverted. This helps to avoid clogging due to the particulate electrode being used in combination with a suspension. Therefore it is preferred to regularly invert the flow direction, e.g. all 3 minutes. Since the electrolysis shall not be affected by the inversion of the flow direction it is important that the packing of the particulate bed of the electrode in both directions is the same. This is obtained by ensuring that the flow and the particulate bed are so that the bed is always tightly pressed against the upper grid or the lower grid retaining the particles within the electrode compartment.

Dependent on the kind of electrode the electrolyte direction of one or both compartments can be inverted.

All vessels 1, 2, 3 are in addition provided with supply means for nitrogen, caustic soda and optionally further supply means as well as with degassing means and solution withdrawal lines for the withdrawal of the leucodye or the anolyte in case of anode cleaning.

Figure 5:
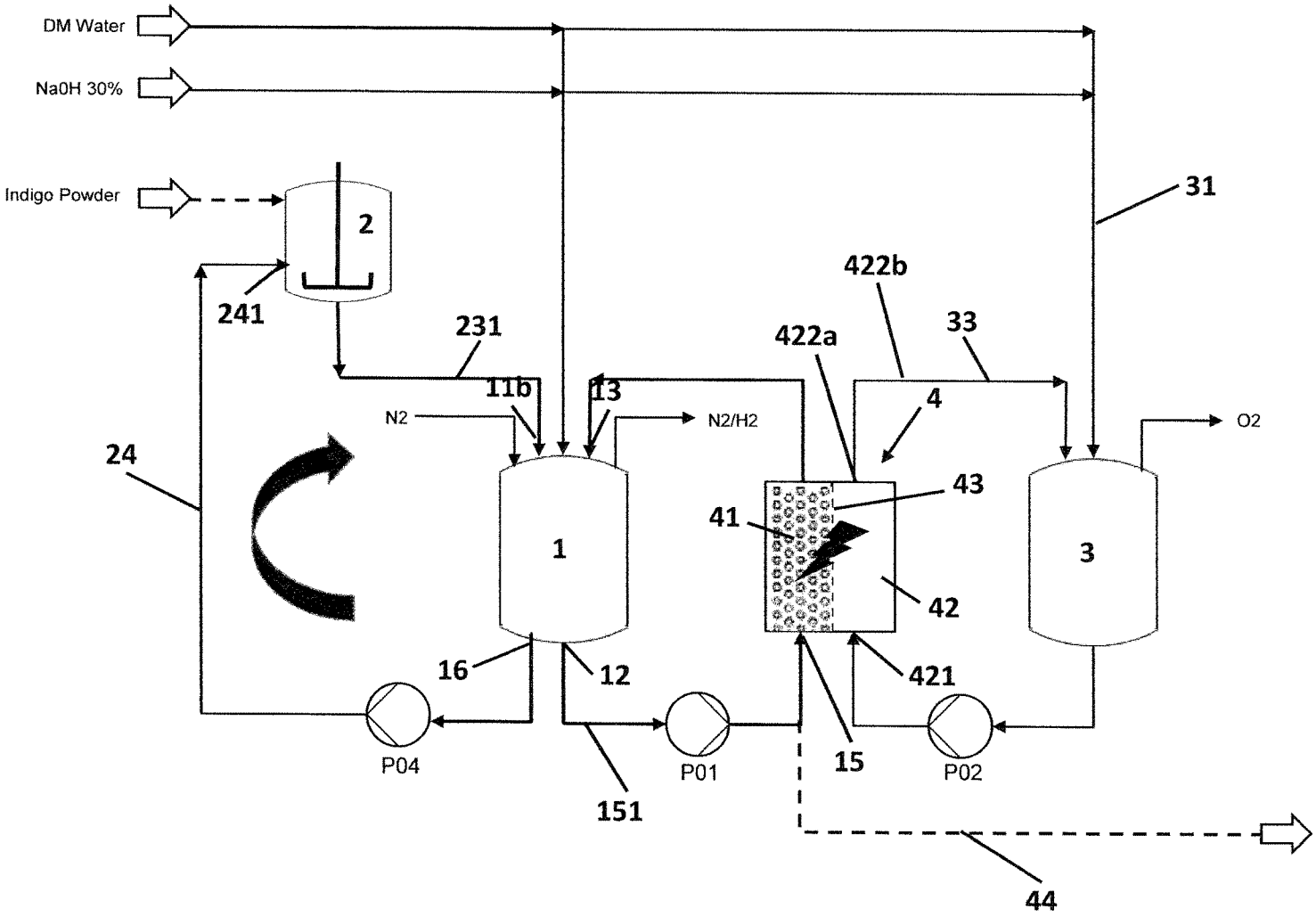
FIG. 5 shows the dye suspension preparation in the presence of a first vessel and with use of internally produced leucodye as dispersing agent.

FIGS. 4 and 5 show catholyte preparation via a first vessel 2 for suspension preparation. Solid dye from solid dye vessel 21*a* is supplied via solid dye inlet 21*b* into a solution of basic electrolyte like caustic soda or leucodye comprising basic electrolyte with desired concentration in first vessel 2. The first vessel can be provided with a first suspension circulation loop 22, optionally equipped with an ultrasound apparatus 221. Once the dye suspension has reached desired homogeneity it is supplied to the main vessel 1 via suspension outlet 23 and dye suspension inlet 11*b*, driven by pump P05. Once the suspension is in main vessel 1, the procedure is as described with regard to FIGS. 1 and 3.

As also already indicated above, for starting dye reduction, in a first preparatory step a diluted suspension is prepared and subjected to electrolytic reduction in electrolytic cell 4. Once the dye has been reduced to leucodye, it can either be supplemented with further dye in the main vessel 1 or—much preferred—some of the leucodye produced can be transferred from the main vessel 1 via leucodye outlet 16, leucodye return pipe 24 equipped with leucodye return pump P04 and leucodye inlet 241 to the first vessel 2 for being supplemented with further dye. The leucodye comprising suspension can then be first processed in the first suspension circulation loop 22 in order to improve its homogeneity before being fed to main vessel 1 and finally to the electrolytic cells as described above.

In a similar way, once the leucodye production has been started, part of the concentrated leucodye is removed and part of the leucodye solution is left in the reactor. This remaining leucodye solution can then be either left in the main vessel 1 or—preferably—fed to first vessel 2 as shown in FIGS. 4 and 5 via leucodye return pipe 24. In the main vessel 1 or preferably in the first vessel 2 the leucodye solution is diluted with additional electrolyte such as caustic soda and supplemented with dye. For producing highly concentrated dispersant-free leucodye solutions, it has proved advantageous to add the basic electrolyte and the leucodye in several parts, returning leucodye solution from main vessel 1 to main vessel 2 for each addition as indicated in the Figures like FIG. 1 as semicircular arrow. In the case of leucoindigo it has been found that concentrations of 5 to 20% are suitable for stabilizing suspensions comprising indigo in amounts of up to 20%.

Once the dye has been reduced to leucodye in the desired concentration, a main part of the leucodye is removed from the reactor via concentrated leucodye outlet 44 and a minor part retained for the next reduction cycle.

In spite of the adsorption filter, the anode has to be regenerated from time to time. This is also the case of the cathode, in particular for particulate carbon cathodes. In order to keep the reactor working it has proved advantageous to clean/regenerate all cathodes of one stack simultaneously during suspension preparation while catholyte is circulated through the other stacks. In a much preferred cathode regeneration step, the water for the suspension preparation is supplied to the main vessel 1 or to the first vessel 2 via the cathode compartment 41. In a continuously producing reactor, e.g. one batch a day, it is usually sufficient to regenerate the cathodes once a week, while the anodes need less frequent regeneration, e.g. once all seven weeks. For a reactor with 6 stacks this means that the cathodes of all stacks are cleaned after six days, with the anodes of one stack being cleaned on the seventh day, the anodes of a second stack on the seventh day of the second week and so on. In case of more than one stacks also reactor shut down can be kept at a minimum. Even if more time consuming maintenance is needed, in general it is sufficient to separate one stack while the other stacks remain working.

It has now been found that the anode cleaning, in particular if polymerized deposits on the anode are kept to a minimum, can easily be performed by circulating acidic cleaning solution through the anode compartment. The same procedure can also be applied for cathodes, in particular for particulate carbon cathodes.

Figure 6:
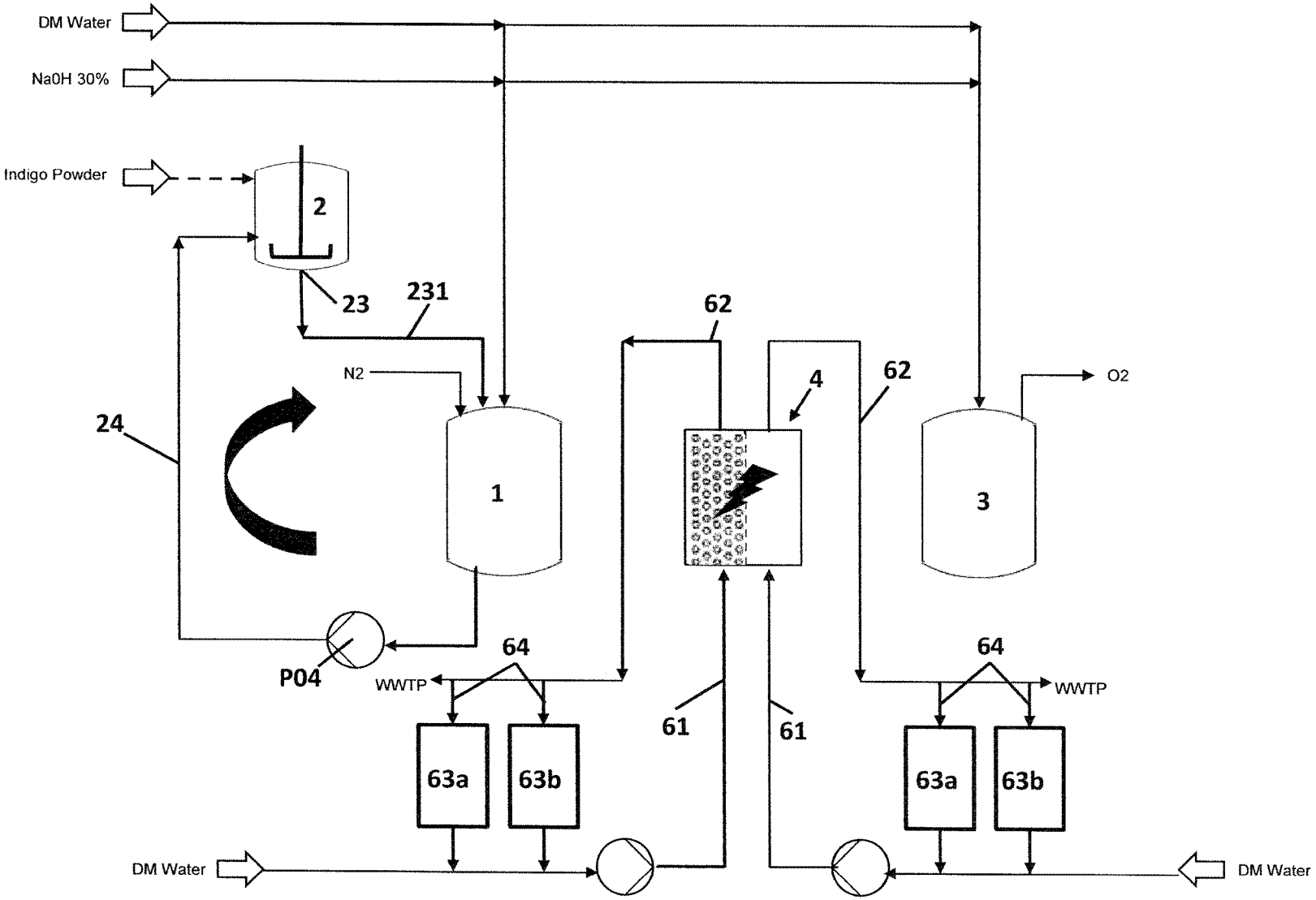
FIG. 6 shows the reactor and method of electrode regeneration by means of electrode washing. The catholyte and anolyte circulation loop are omitted for clarity reason. There is no circulation of anolyte and catholyte in the electrolyte cell during washing.

For this cleaning or regeneration step, as shown in FIG. 6, the electrochemical reactor is also provided with means for supplying cleaning solutions to the stacks of electrolytic cells or rather the electrolytic cells. These means comprise at least one cleaning medium supply pipe 61 for supplying cleaning/regeneration solutions to the cathode or anode and—on the side of the electrolytic cell opposite to the inlet—at least one cleaning medium removal pipe 62 for removing acidic cleaning solutions and water and preferably also a basic solution. These cleaning medium supply pipes 61 can be bypasses of a catholyte supply pipe 151 and an anolyte supply pipe 31, i.e. using the same inlets and outlets, or independent pipes with own inlets and outlets adjacent to the ones of the catholyte circulation loop or the anolyte circulation loop. In general, the one or more cleaning medium supply pipes 61 are connected to acid vessels 63*a* for supplying acid, and optionally to base vessels 63*b* for supplying base, as well as to a water line supplying deionized water. The one or more cleaning medium removal pipes 62 are either directly fed to a waste water treatment plant (WWTP) or to waste water vessels for storing waste water. In a preferred embodiment, the cleaning solutions are circulated for some time, i.e. until their pollution reaches an undesired level. In case of circulation, the cleaning medium removal pipe 62 is connected to a vessel 63*a*, 63*b* via cleaning medium circulation means 64. In this case it is preferred to have one or more particle filters and/or adsorption filters for retaining small particles of metallic origin and abraded electrode material or for adsorbing dissolved contaminants placed somewhere in the cleaning cycle, preferably in the cleaning medium circulation pipe 64 just downstream the electrolytic cells.

Cleaning or regenerating, respectively, an anode or both electrodes in an electrochemical reactor of the present invention comprises washing the anode and/or cathode compartments 41, 42 with strong acids (pK<1) by circulating the acidic solution through the compartments 41, 42, in particular the electrode bed, followed by washing the compartment(s) 41, 42 with water, optionally and preferably after having washed the acid treated compartment(s) 41, 42 with a basic solution, preferably caustic soda, for more efficient acid and electrode contamination removal.

This regeneration step e.g. removes deposits from the anode and also metals like iron and/or nickel from the particle surface of particulate carbon based cathodes. Since such metals are assumed to have catalytic effect on $H_2$-generation that competes the desired reduction such washing step is of significant benefit for the whole performance of the electrolytic reactor besides of the removal of other deposits.

In case of indigo reduction, the acid washing is performed for a suitable time such as 10 to 60 min. followed by washing the bed with a base like caustic soda (to remove the acid and contamination of the electrode) followed by water washing or—less preferred—by washing with water directly. While the washing can be performed for both electrodes, i.e. the cathode and the anode simultaneously, a procedure as described above is preferred.

Suitable acidic solutions have a concentration in the range of 10 to 100 g/l, more preferred 40 to 60 g/l, most preferred about 50 g/l, or 0.25 to 30 M, preferably 1 to 2 M, more preferred 1.3 to 1.4 M (referred to the protons) in deionized water. If a basic solution like caustic soda is used following the acid solution cleaning, the concentration in general is in the range of 10 to 100 g/l, more preferred 20 to 60 g/l, most preferred 40 g/l, or 0.1 to 2.5 M, preferably 0.5 to 1.5 M (referred to hydroxide) in deionized water.

For the regeneration step the strong acid is preferably selected from the group consisting of HCl, $H_2SO_4$, $HNO_3$ and mixtures thereof.

While there are shown and described presently preferred embodiments of the invention, it is to be distinctly understood that the invention is not limited thereto but may be otherwise variously embodied and practiced within the scope of the following claims.

LIST OF REFERENCE NUMBERS

1 main vessel
11*a* solid dye inlet
11*b* dye suspension inlet
12 catholyte outlet
13 reduced catholyte inlet
14 main suspension circulation loop
P03 main suspension circulation pump
141 ultrasound apparatus in main suspension circulation loop
15 catholyte circulation pipe or catholyte circulation loop
151 catholyte supply pipe
P01 catholyte supply pump
152 particle filter in catholyte supply pipe
153 catholyte heating means (heat exchanger)
154 ultrasound apparatus in catholyte supply pipe
16 leucodye outlet
2 first vessel
21*a* solid dye vessel
21*b* solid dye inlet
22 first suspension circulation loop
221 ultrasound apparatus in first suspension circulation loop
23 first suspension outlet
231 first suspension supply pipe
P05 first suspension supply pump
24 leucodye return pipe
241 leucodye inlet
25 first suspension mixer
P04 leucodye return pump
3 anolyte vessel
31 anolyte supply pipe
32 anolyte outlet
33 anolyte circulation pipe or anolyte circulation loop
331 anolyte heating means such as heat exchanger
332 adsorption filter
P02 anolyte pump
35 anolyte inlet
4 electrolytic cell with
41 catholyte compartment or cathode compartment
411 catholyte inlet
412*a* reduced catholyte outlet
412*b* reduced catholyte return pipe
413*a* bypass for changing catholyte direction
413*b* bypass for changing catholyte direction
42 anolyte compartment or anode compartment
421 anolyte inlet
422*a* anolyte outlet
422*b* anolyte return pipe
43 separator, semipermeable membrane
44 concentrated leucodye outlet (batchwise)
5 stack of electrolytic cells
61 cleaning medium supply pipe
62 cleaning medium removal pipe
63*a* acid vessel
63*b* base vessel
64 cleaning medium circulation means

The invention claimed is:

1. An electrolytic reactor suitable for reducing a vat dye or sulphur dye, said reactor comprising at least one electrolytic cell with an anode compartment and a cathode compartment, said compartments being separated by a separator, said compartments each comprising an inlet and an outlet for anolyte and catholyte, respectively, at opposed ends, said inlet and outlet of the anode compartment being connected with each other via an anolyte circulation pipe and said inlet and outlet of the cathode compartment being connected with each other via catholyte circulation pipe, said anolyte circulation pipe being equipped with an anolyte vessel to form an anolyte circuit and said catholyte circulation pipe being equipped with a main vessel to form a catholyte circuit, wherein the anolyte circulation pipe is further equipped with at least one adsorption filter, said adsorption filter comprising an adsorption material for adsorbing molecular impurities, said catholyte circuit comprising a catholyte comprising a vat dye or sulphur dye.

2. The electrolytic reactor of claim 1, wherein the adsorption material in the adsorption filter comprises activated carbon or molecular sieves such as zeolites.

3. The electrolytic reactor of claim 2, wherein the adsorption material in the adsorption filter comprises or consists of activated carbon.

4. The electrolytic reactor of claim 1, wherein the adsorption material in the adsorption filter comprises particles with particle size of 1 to 3 mm.

5. The electrolytic reactor of claim 1, wherein the cathode compartment comprises a particulate cathode.

6. The electrolytic reactor of claim 5, wherein the particulate cathode is a conductive carbon cathode.

7. The electrolytic reactor of claim 1, wherein the catholyte comprises indigo.

8. The electrolytic reactor of claim 1, wherein said main vessel is provided with a main suspension circulation loop for a circulating dye suspension.

9. The electrolytic reactor of claim 8, wherein the main vessel is coupled with a first vessel for suspension preparation so that a suspension from the first vessel can be fed to the main vessel and a leucodye solution can be fed from the main vessel back into the first vessel.

10. The electrolytic reactor of claim 9, wherein the first vessel is provided with a first suspension circulation loop.

11. The electrolytic reactor of claim 10, wherein said first suspension circulation loop is equipped with an ultrasound apparatus for circulating the first suspension prior to its delivery to the main vessel.

12. The electrolytic reactor of claim 8, wherein said main suspension circulation loop is equipped with an ultrasound apparatus.

13. The electrolytic reactor of claim 1, wherein the at least one electrolytic cell comprises at least 4 electrolytic cells in the form of at least two stacks of electrolytic cells, wherein the electrolytic cells of one stack as well as all stacks are connected in parallel.

14. The electrolytic reactor of claim 1 wherein at least one of the anode compartment and the cathode compartment are independently from each other provided with cleaning means for providing one or more cleaning solutions and water and cleaning means for removing one or more cleaning solutions and water.

15. The electrolytic reactor of claim 14, wherein at least one of the anode compartment and the cathode compartment are independently from each other provided with cleaning means for circulating one or more cleaning solutions and water.

16. The electrolytic reactor of claim 1 wherein said separator is a semipermeable membrane.

17. A method for improving anode performance in vat dye or sulfur dye reduction, said method comprising continuous cleaning of anolyte in an adsorption filter integrated in an anolyte circulation pipe or anolyte circulation loop, respectively, by continuously flowing the anolyte through the adsorption filter; wherein said anolyte circulation pipe or anolyte circulation loop connects an inlet of an anode compartment with an outlet of an anode compartment and wherein said inlet and said outlet are disposed at opposed ends of said anode compartment, and said anolyte circulation pipe or anolyte circulation loop is equipped with an anolyte vessel to form an anolyte circuit.

18. The method of claim 17 wherein the dye is indigo.

19. A method for removing undesired molecular products and/or by-products and/or impurities from an anolyte in an electrochemical vat dye or sulfur dye reduction process, wherein at least part of said undesired products and/or by-products and/or impurities are reaction products and/or by-products and/or impurities present or formed in the catholyte, and which pass through the semi-permeable membrane into the anolyte where they are adsorbed on an adsorption filter resulting in the purification of the catholyte; wherein said adsorption filter is integrated in an anolyte circulation pipe or anolyte circulation loop connecting an inlet of an anode compartment with an outlet of the anode compartment and wherein said inlet and said outlet are disposed at opposed ends of said anode compartment, and said anolyte circulation pipe or anolyte circulation loop is equipped with an anolyte vessel to form an anolyte circuit.

20. The method of claim 19, wherein the dye is indigo.

* * * * *